US010540836B2

(12) United States Patent
Bengtsson et al.

(10) Patent No.: US 10,540,836 B2
(45) Date of Patent: Jan. 21, 2020

(54) COIN DEPOSIT AND DISPENSING MACHINE AND A METHOD FOR CONTROLLING OUTPUT OF COINS FROM A COIN DEPOSIT AND DISPENSING MACHINE

(71) Applicant: Scan Coin AB, Malmo (SE)

(72) Inventors: Kristian Bengtsson, Bjarred (SE); Hakan Melin, Akarp (SE)

(73) Assignee: Scan Coin AB, Malmo (SE)

( * ) Notice: Subject to any disclaimer, the term of this patent is extended or adjusted under 35 U.S.C. 154(b) by 39 days.

(21) Appl. No.: 15/485,276

(22) Filed: Apr. 12, 2017

(65) Prior Publication Data

US 2017/0309103 A1 Oct. 26, 2017

(30) Foreign Application Priority Data

Apr. 25, 2016 (SE) ..... 1650550

(51) Int. Cl.
*G07D 3/00* (2006.01)
*G07D 9/00* (2006.01)
(Continued)

(52) U.S. Cl.
CPC ..... *G07D 3/00* (2013.01); *G07D 1/00* (2013.01); *G07D 1/02* (2013.01); *G07D 9/002* (2013.01);
(Continued)

(58) Field of Classification Search
CPC .. G07D 1/00; G07D 1/02; G07D 1/04; G07D 1/06; G07D 1/08; G07D 3/00; G07D 3/02;
(Continued)

(56) References Cited

U.S. PATENT DOCUMENTS 3,237,853 A 3/1966 Gorsswiller, Jr.
5,146,070 A * 9/1992 Toma ..... G06K 13/08 235/475
(Continued)

FOREIGN PATENT DOCUMENTS

DE 10 2012 005018 9/2013
EP 1 843 302 10/2007
(Continued)

OTHER PUBLICATIONS

European Search Report from corresponding European patent application No. 17167446.8.

*Primary Examiner* — Jeffrey A Shaprio
(74) *Attorney, Agent, or Firm* — Womble Bond Dickinson (US) LLP

(57) ABSTRACT

A coin depositing and dispensing machine (100) comprises: a front face (102); a coin input unit (104); a coin processing unit (106); at least one container (110) for storing coins of a specific denomination; and a coin output unit (120), comprising a first element (122) and a second element (124) carrying the first element (122), wherein the first element (122) in a first position (122A) is arranged relative the at least one container (110) for receiving coins from the at least one container (110), wherein the first element (122) is displaceable relative the second element (124) from the first position (122A) towards the front face (102) to a second position (122B), and wherein the second element (124), when the first element (122) is in the second position (122B), is displaceable for carrying the first element (122) to an output position (122C), where the first element (122) at least partially protrudes from the front face (102).

12 Claims, 3 Drawing Sheets

Figure 1:
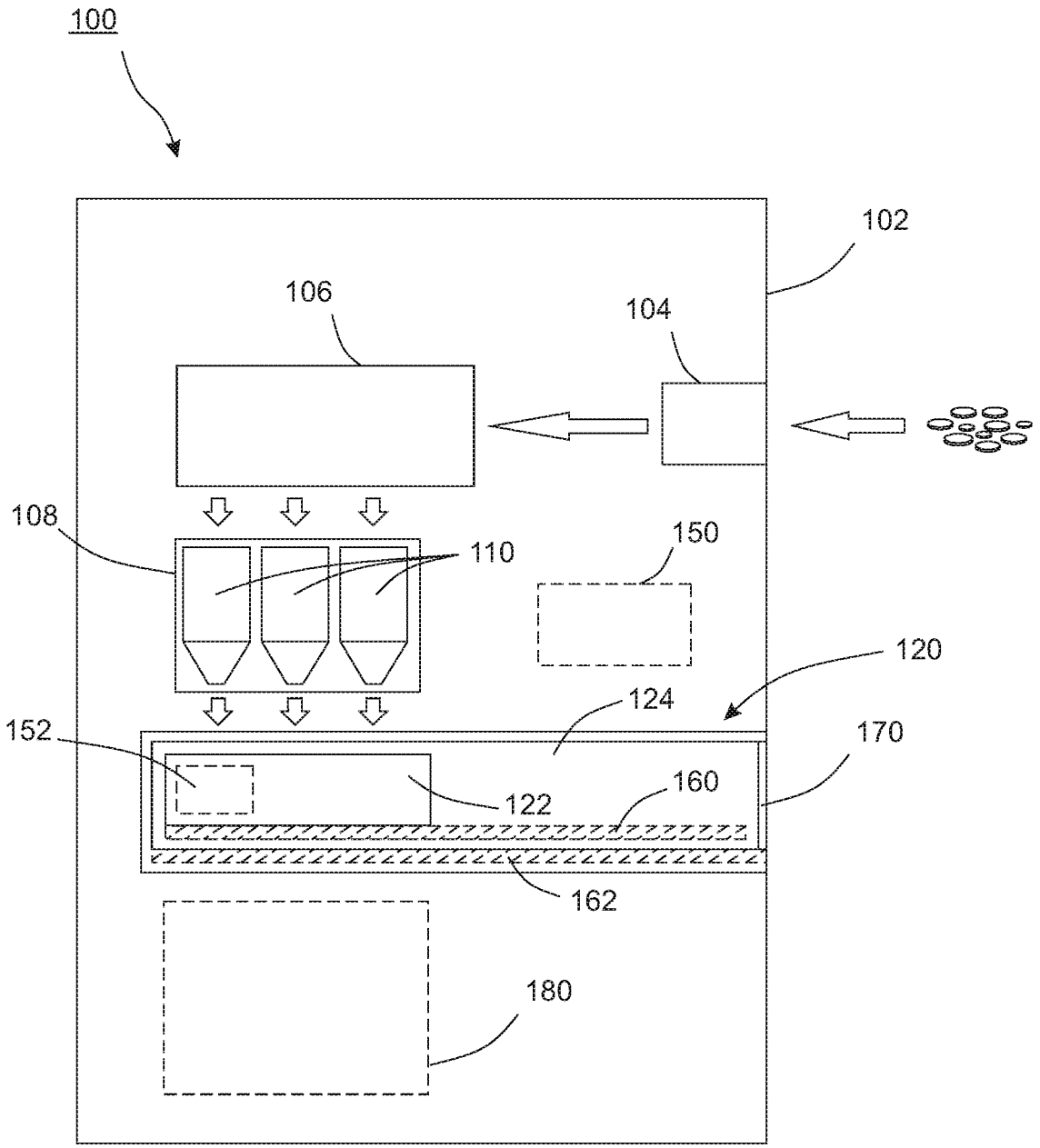

(51) Int. Cl.

| | |
|---|---|
| ***G07D 11/23*** | (2019.01) |
| ***G07F 9/06*** | (2006.01) |
| ***G07D 9/02*** | (2006.01) |
| ***G07D 11/00*** | (2019.01) |
| ***G07D 1/00*** | (2006.01) |
| ***G07D 1/02*** | (2006.01) |

(52) U.S. Cl.
CPC ..... *G07D 9/008* (2013.01); *G07D 9/02* (2013.01); *G07D 11/00* (2013.01); *G07D 11/23* (2019.01); *G07F 9/06* (2013.01)

(58) Field of Classification Search
CPC .. G07D 3/04; G07D 3/06; G07D 3/08; G07D 3/10; G07D 3/12; G07D 3/121; G07D 3/123; G07D 3/125; G07D 3/126; G07D 3/128; G07D 3/14; G07D 3/16; G07D 9/02; G07D 9/002; G07D 9/008; G07D 11/00; G07D 11/23; G07F 9/06; G07G 1/0018
USPC .... 453/1–3, 5, 9, 16, 17–19, 29, 30, 39, 58; 194/215–218, 344, 350
See application file for complete search history.

(56) References Cited

U.S. PATENT DOCUMENTS

| | | | | |
|---|---|---|---|---|
| 5,940,306 | A * | 8/1999 | Gardner | E05B 65/46 221/12 |
| 7,021,529 | B2 | 4/2006 | Enright et al. | |
| 7,494,001 | B2 | 2/2009 | Haruna et al. | |
| 7,500,568 | B2 | 3/2009 | Cousin | |
| 7,625,272 | B1 * | 12/2009 | Moreland | G07D 3/14 141/358 |
| 8,109,379 | B2 | 2/2012 | Sjostrom | |
| 2004/0206811 | A1 | 10/2004 | Enright et al. | |
| 2005/0284925 | A1 * | 12/2005 | Ahn | G07F 19/20 235/379 |
| 2006/0217052 | A1 * | 9/2006 | Barnekow | G07D 3/14 453/3 |
| 2006/0283685 | A1 | 12/2006 | Cousin | |
| 2007/0034683 | A1 | 2/2007 | Eastman et al. | |
| 2007/0072533 | A1 | 3/2007 | Haruna et al. | |
| 2007/0210149 | A1 * | 9/2007 | Osterberg | G06Q 20/1085 235/379 |
| 2008/0085671 | A1 | 4/2008 | Nishida | |
| 2008/0087521 | A1 | 4/2008 | Cole | |
| 2013/0205723 | A1 | 5/2013 | Blake et al. | |
| 2013/0184856 | A1 * | 7/2013 | Gregerson | G07F 11/005 700/232 |
| 2013/0199422 | A1 | 8/2013 | Starke et al. | |
| 2014/0080395 | A1 * | 3/2014 | Takeuchi | G07D 1/00 453/3 |
| 2015/0042136 | A1 * | 2/2015 | Rajasingham | B60N 2/01 297/250.1 |
| 2015/0262447 | A1 | 9/2015 | Zander et al. | |
| 2015/0345182 | A1 * | 12/2015 | Carlson | E05B 39/02 70/263 |
| 2016/0379432 | A1 * | 12/2016 | Lavigne | G07D 3/14 453/3 |

FOREIGN PATENT DOCUMENTS

| | | |
|---|---|---|
| GB | 2 122 009 | 1/1984 |
| GB | 2 320 604 | 6/1998 |
| JP | S53-28786 | 3/1978 |
| WO | WO 99/41712 | 8/1999 |

* cited by examiner

COIN DEPOSIT AND DISPENSING MACHINE AND A METHOD FOR CONTROLLING OUTPUT OF COINS FROM A COIN DEPOSIT AND DISPENSING MACHINE

CROSS-REFERENCE TO RELATED APPLICATION

The present application claims the benefit of Swedish Patent Application No. 1650550-5, filed Apr. 25, 2016. The foregoing application is incorporated herein in its entirety by this reference.

FIELD OF THE INVENTION

The present disclosure relates to an apparatus and method for coin handling. More specifically, the disclosure relates to an apparatus and method for a coin depositing and dispensing machine.

BACKGROUND ART

Coin deposit and dispensing machines are known in the art. Coin deposit and dispensing machines may typically be used for allowing insertion and/or retraction of coins in relation to a bank account or for exchanging coins to notes or coins of other denominations. A coin deposit and dispensing machine may be arranged to recycle coins, i.e. coins inserted to the machine may in a later transaction be output from the machine.

One type of coin deposit and dispensing machines comprise a machine body with a front face at which a user is presented with an interface with which to operate the machine. The machine further comprises a coin input unit for input of coins into the machine and a coin processing unit which is arranged to receive coins input through the coin input unit. The coin processing unit determines a denomination of coins and sorts coins according to denomination. The machine further comprises a coin storage unit comprising at least one container for storing coins of a specific denomination. The machine further comprises a coin output unit which is arranged to receive coins output from the coin storage unit. The coin output unit may for example comprise a drawer in which to place a portable receptacle, such as for example a cash till, arranged to be easily removed from the drawer. The drawer may be opened, presenting the coins for the user for retrieval. One such coin deposit and dispensing machine is known from U.S. Pat. No. 8,109,379.

A challenge with designing coin depositing and dispensing machines is that internal mechanical systems e.g. for transport of coins between different part of the machine, may require quite some space. Also, the machine may be designed to be robust and reliable, which may imply that the internal mechanical systems become large. Based for instance on such considerations, the coin storage unit may be located far from the front face of the machine and possibly even in the vicinity of the rear of the machine. From a user perspective, access to dispensed coins should be provided in a way that is easy and ergonomic for the user. As the user is operating the machine in front of the front face of the machine, it may not be easy to provide dispensed coins in an ergonomic way to the user as the coins are output from the coin storage unit placed far from the front face of the machine.

SUMMARY

It is an object to mitigate, alleviate or eliminate one or more of the above-identified deficiencies in the art and disadvantages singly or in any combination and solve at least the above mentioned problem.

According to a first aspect, these and other problems are solved in full, or at least in part, by a coin depositing and dispensing machine, said machine comprising: a front face; a coin input unit for input of coins into the machine; a coin processing unit, which is arranged to receive coins input through the coin input unit, to determine a denomination of coins, and sort coins according to denomination; a storage unit comprising at least one container for storing coins of a specific denomination; and a coin output unit, comprising a first element and a second element, the second element being arranged to carry the first element, wherein the first element in a first position is arranged in relation to the at least one container for receiving coins output from the at least one container, wherein the first element is displaceable in relation to the second element from the first position in a direction towards the front face to a second position in a vicinity of the front face, and wherein the second element, when the first element is in the second position, is displaceable in relation to the front face for carrying the first element to an output position, where the first element at least partially protrudes from the front face.

According to the invention, the coin output unit comprising two elements which are movable with respect to each other and with respect to the front face. This implies that the coin output unit may displace an element between a first position for receiving coins and a second position, prepared for presenting coins to the user. Thus, when coins are to be output to a user, the elements need not be extended far from the front face of the machine in order for a coin holding unit to protrude from the front face and be easily accessible to the user. Thus, coins may be easily and ergonomically accessible for the user regardless whether the coin storage unit is arranged far from the front face of the machine.

More specifically, the coin output unit comprises a first element and a second element. The second element is arranged to carry the first element. The first element, when being in a first position, is arranged in relation to the at least one container for receiving coins output from the at least one container. The first element is displaceable in relation to the second element from the first position in a direction towards the front face to a second position in a vicinity of the front face. When the first element is in the second position, the second element is displaceable in relation to the front face. Thus the first element may be carried to an output position where the first element at least partially protrudes from the front face. The user standing in front of the front face may now easily and ergonomically access the coins.

The coin output unit disclosed hereinabove is advantageous as it allows a solution to the problem without having to introduce an additional transport system for transporting coins from the coin storage unit to the coin output unit. This simplifies the mechanical structure of the machine and increases the reliability of operation. A further advantage of the coin output unit disclosed hereinabove is that it allows repositioning the first element internally within the coin depositing and dispensing machine such that coins output from the coin storage unit may be directed to other parts of the machine. This is advantageous if the amount of coins in the coin storage unit becomes close to a maximum fill level in the coin storage unit, such that input of coins to the machine may be prevented. Then, the repositioning of the first element may allow an overflow of coins in a container of the coin storage unit to be output from the coin storage unit without the coins being provided to any unauthorized user (by the coins being output to the first element). Rather, when the first element is repositioned, coins from the coin storage unit may be output to an overflow compartment, not accessible to unauthorized users and which may, for instance, be arranged below the first position of the first element to allow coins from the coin storage unit fall by gravity from the coin storage unit into the overflow compartment According to one embodiment, the coin depositing and dispensing machine further comprises a control unit, arranged to determine the position of the first element with respect to the front face. The control unit may thus ensure that the first element is in a correct position before sending any control signal to allow e.g. dispensing of coins from the coin storage unit or output of coins by displacing the second element to carry the first element to the output position.

According to one embodiment, the coin depositing and dispensing machine further comprises a displacing unit, arranged to displace the first element in relation to the second element between at least the first position and the second position. The displacing unit may include a motor and may be arranged in relation to the first and second elements for acting on the first element so as to displace the first element.

According to one embodiment, the first element is box-shaped defining a space for receiving coins. The first element may in one embodiment have a single compartment for receiving coins from several containers of the coin storage unit. In another embodiment, the first element may have several compartments such that coins may be sorted by denominations by the compartments receiving coins from different containers.

According to one embodiment, the first element is linearly displaceable in relation to the second element. A linear movement between the first and the second elements may be easily controlled.

According to one embodiment, the first element is movably mounted to the second element by means of a first rail system.

According to one embodiment, the second element is movably mounted to the coin depositing and dispensing machine by means of a second rail system.

According to one embodiment, the second element has a front plate, which is arranged to be flush with the front face in a closed position of the second element. This implies that second element may seal the front face of the machine tightly to prevent unauthorized users from accessing the coin storage unit through an opening in the front face accommodating the second element.

According to one embodiment, the first element is arranged to receive a receptacle having compartments for receiving different denominations of coins. Thus, if a user wants coins to be output in a sorted manner, the first element may first be brought to the output position, allowing the user to arrange the receptacle in the first element before requesting withdrawal of coins. Then, the coins may be output to the receptacle in the first element allowing the user to remove the receptacle and leave the machine with coins sorted by denominations in the receptacle.

According to one embodiment, the coin depositing and dispensing machine further comprises a transport box arranged to receive coins from the storage unit when the first element is in the second position. The transport box may be adapted to receive coins when there is a risk of overflow of coins in a container in the coin storage unit.

Cash-in-transit (CIT) personnel may empty coins from the transport box at appropriate times. In one embodiment, the transport box is accessible from the rear of the machine allowing the CIT personnel to empty the machine from a rear face of the machine. The machine may even be wall-mounted, such that the front face and the rear face are separated by a wall, allowing CIT personnel to work in a secure area.

The machine may also comprise an input unit at the rear face, allowing CIT personnel to fill the machine with coins if the machine is close to having a shortage of coins.

According to a second aspect, there is provided a method for controlling output of coins from a coin depositing and dispensing machine, comprising: determining, by a control unit, that a first element is in a first position commensurate with an output of a storage unit, outputting coins from the storage unit, displacing the first element from the first position to a second position, controlling, by the control unit, that the first element is in the second position, displacing a second element, said second element being arranged to carry said first element, in relation to a front face of the coin depositing and dispensing machine for carrying the first element to an output position, where the first element at least partially protrudes from the front face of the coin depositing and dispensing machine, whereby a user is allowed to retrieve coins output from the coin depositing and dispensing machine.

The method allows output of coins in a manner that is easy and ergonomic to a user as explained above in relation to the first aspect. Also, thanks to the control unit controlling the position of the first element, the control unit may ensure that the coin deposit and dispensing machine does not take any actions unless the first element is in a correct position.

According to one embodiment, the method further comprises detecting a fill level of coins in a container of the storage unit, comparing the fill level to a threshold value and, in case the fill level is above the threshold value, displacing the first element from the first position to the second position and outputting, by the storage unit, coins from the container of the storage unit to a transport box.

Thus, the coin deposit and dispensing machine may easily shift between output of coins to the first element for presentation to a user and output of coins to a transport box for handling overflow of coins in containers.

BRIEF DESCRIPTIONS OF THE DRAWINGS

The invention will by way of example be described in more detail with reference to the appended schematic drawings, which shows presently preferred embodiments of the invention.

FIG. 1 shows a schematic side view of a coin depositing and dispensing machine according to an embodiment of the present disclosure.

Figure 2A:
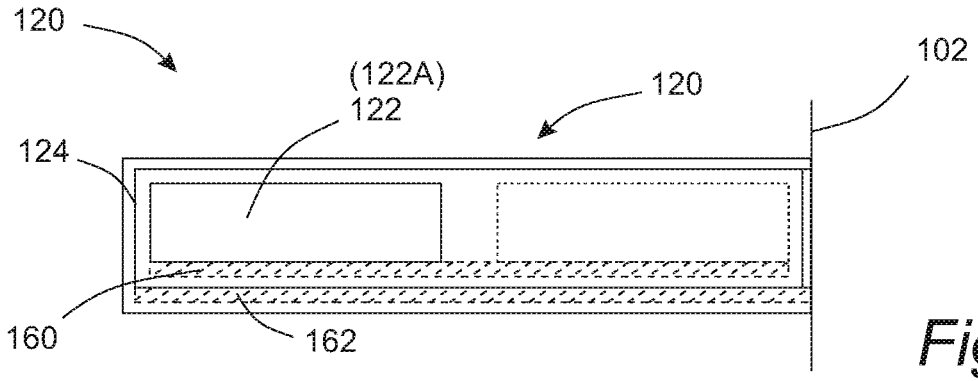
Figure 2B:
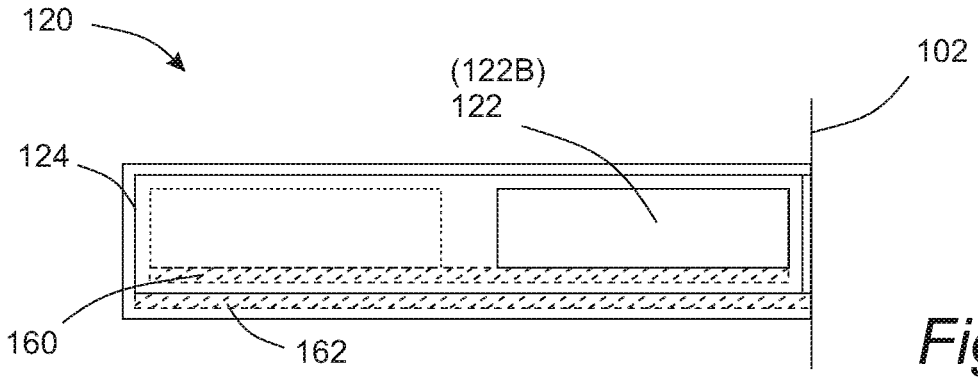
Figure 2C:
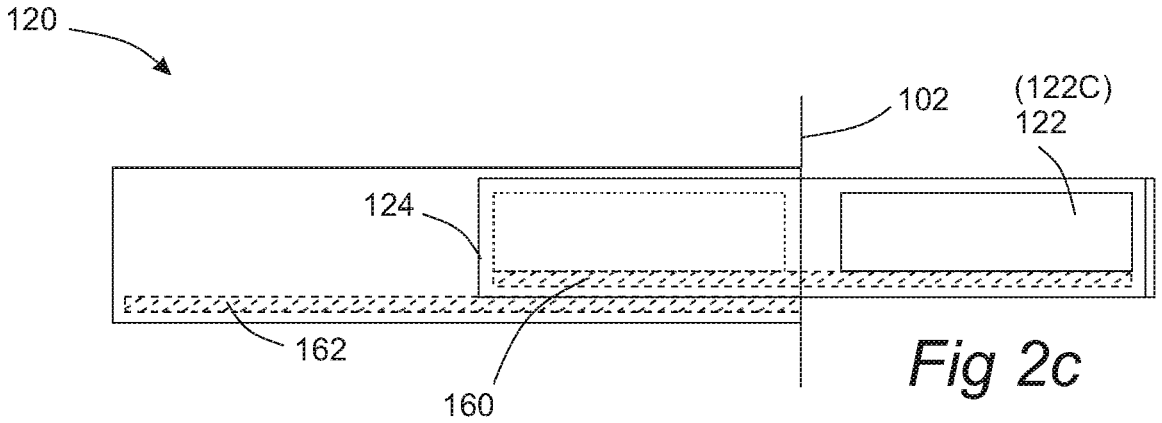

FIGS. 2*a-c* shows a schematic side view of the output unit of the coin depositing and dispensing machine in different positions according to an embodiment of the present disclosure.

Figure 3A:
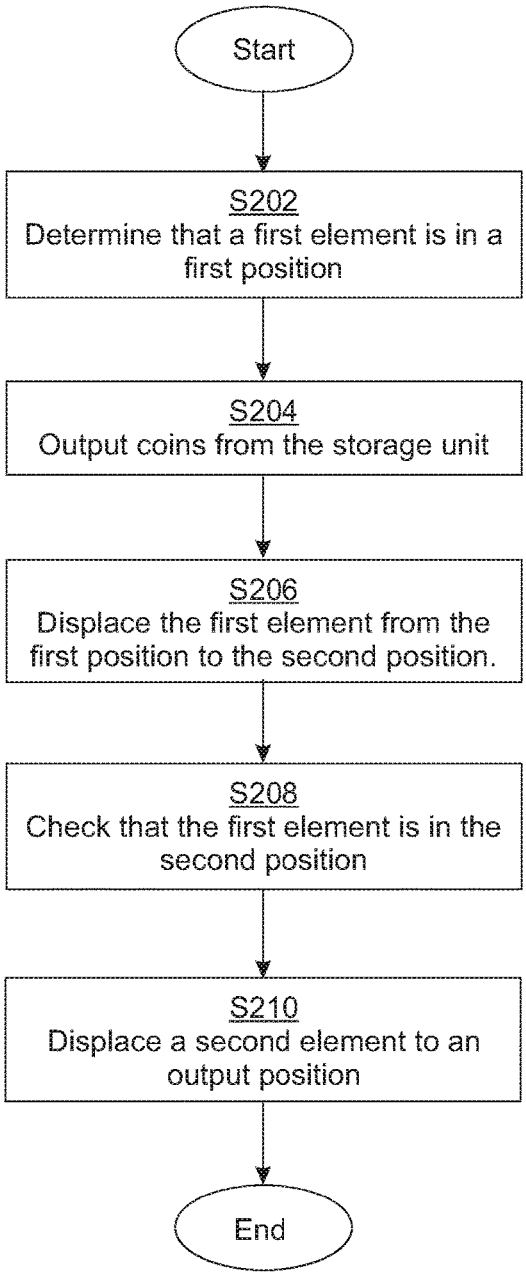
Figure 3B:
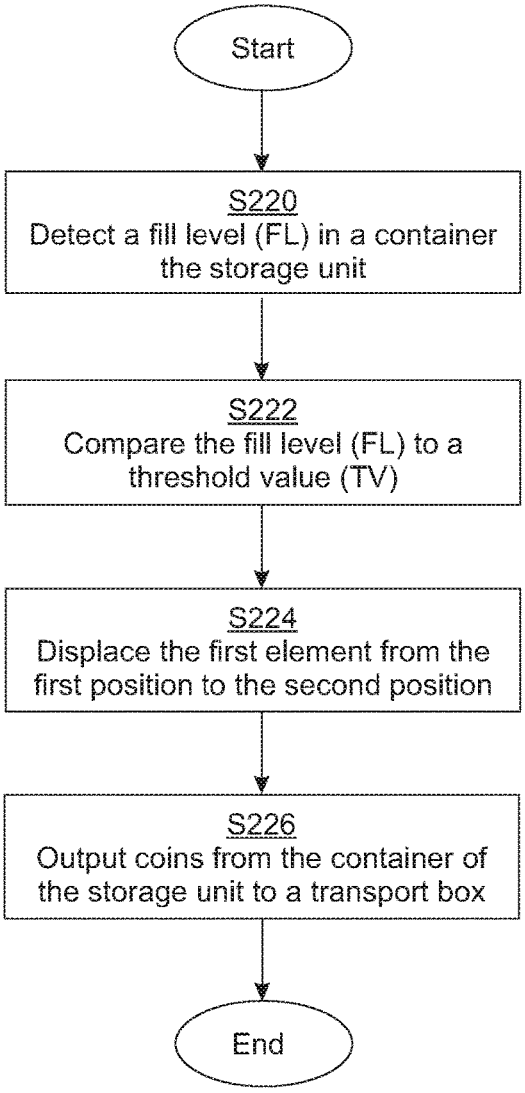

FIGS. 3*a-b* show flow charts of a method for a coin depositing and dispensing machine according to an embodiment of present disclosure.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Referring to FIG. 1, a coin depositing and dispensing machine 100 is shown schematically in a side view.

The coin depositing and dispensing machine 100 comprises a front face 102. The front face 102 is facing a user that intends to deposit or dispense coins from the machine 100. The front face 102 may be planar but may, alternatively, be curved. Typically, the front face 102 is aligned vertical or close to vertical. There may, however, be portions of the front face 102 which are not vertical or close to vertical. For example, parts of the front face 102 could be aligned horizontal or close to horizontal. The front face may be arranged in any manner in order to provide an ergonomic posture of a user that interacts with the machine 100.

The coin depositing and dispensing machine 100 further comprises a coin input unit 104 for input of coins into the machine 100. The purpose of the coin input unit 104 is to allow a user to input coins to the machine. A further purpose of the coin input unit 104 is to allow transport of the coins from the coin input unit 104 further into the machine 100.

The coin depositing and dispensing machine 100 further comprises a coin processing unit 106. The coin processing unit 106 is arranged to receive coins input through the coin input unit 104, to determine a denomination of coins, and sort coins according to denomination.

The coin depositing and dispensing machine 100 further comprises a coin storage unit 108 comprising at least one container 110 for storing coins of a specific denomination. Each one of the at least one container 110 comprises an output from which coins may leave the at least one container 110.

Each container 110 may have an ejector/counter at the bottom of the container 110 for outputting coins from the container 110. The ejector/counter may be controlled e.g. by a control signal to selectively activate output of coins from the container 110. The ejector/counter may be of any type known per se, such as electromechanical or pneumatic.

The internal transport and sorting of coins from the coin input unit 104, via the coin processing unit 106 and to the coin storage unit 108 is not explicitly disclosed herein. It should be understood that many alternative ways exist for achieving said internal transport and sorting of coins within the scope of the claims.

The coin depositing and dispensing machine 100 further comprises a coin output unit 120. The purpose of the coin output unit 120 is to, at the request of a user, receive, from the coin storage unit 108, a predefined amount of coins of one or more denominations, said coins corresponding to a predefined sum of money. The further purpose of the coin output unit 120 is to present the coins to the user in such a way as to let the user easily and ergonomically retrieve the coins from the coin depositing and dispensing machine 100.

The coin output unit 120 comprises a first element 122 and a second element 124 where the second element 124 is arranged to carry the first element 122. The first element 122 is displaceable in relation to the second element 124. The second element 124 is displaceable in relation to the front face 102 of the coin depositing and dispensing machine 100.

The purpose of the first element 122 is to carry coins output from the coin storage unit 120. Thus, the first element 122 may be regarded as the coin-carrying element. At least part of the first element 122 may be box-shaped defining a space for receiving coins. Additionally, or alternatively, the first element 122 may be arranged to receive a receptacle having compartments for receiving different denominations of coins. The first element 122 and the receptacle will be arranged such that the receptacle will follow the movement of the first element 122 when the first element 122 is displaced in relation to the second element 124 and/or in relation to the front face 102. This may be realized by the receptacle having dimensions corresponding to the inner dimensions of a box-shaped part of the first element 122. Alternatively, the receptacle may be secured to the first element 122 in other ways, such as e.g. by securing pins in the first element corresponding to holes in the receptacle.

A receptacle secured to, or residing in, the first element may be regarded as the coin-carrying element. As it is understood from the description hereinabove that the receptacle will follow the movement of the first element 122, the following description will be referring to the first element 122 only. It is further understood that the coin depositing and dispensing machine 100 operates in the same way regardless of whether a receptacle is used or not.

The coin output unit 120 will now be further discussed with reference to FIGS. 2*a, b* and *c* showing side views of the coin output unit 120 for three positions of the first element 122.

FIG. 2*a* shows the coin output unit 120 in a closed state, characterized by the second element 124 being in a closed position. When the coin output unit 120 is in a closed state, the user cannot access the content of the first element 122. The first element 122, when being in a first position 122A (see FIG. 2*a*), is arranged in relation to the at least one container 110 such as to receive coins output from the at least one container 110. The first position 122A may be directly under the at least one container 110, allowing for the coins to reach the first element 122 by falling from the output of the at least one container 110 at the force of gravity. Alternatively, the first position 122A may be horizontally offset to the at least one container 110. The coins may then be guided to the first element by means of an additional guiding unit, comprising for example a plurality of tubes.

Even though a plurality of tubes may be used, the possibility of displacing the first element 122 in the machine 100 may imply that the tubes may not need to transport coins a long distance.

FIG. 2*b* also shows the coin output unit 120 in a closed state characterized by the second element 124 being in a closed position. The first element 122 is displaceable in relation to the second element 124 from the first position 122A in a direction towards the front face 102 to a second position 122B in a vicinity of the front face 102. Likewise, the first element 122 is also displaceable in relation to the second element 124 from the second position 122B in a direction away from the front face 102 to the first position 122A.

As the displacement of the first element 122 in relation to the second element 124 occurs when the coin output unit 120 is in a closed state, the displacement may preferably be realized by a displacing unit 152. The displacing unit 152 is arranged to displace the first element 122 in relation to the second element 124 between at least the first position 122A and the second position 122B. The displacing unit may for example comprise a stepper motor, which may be connected to the first and/or second elements for driving a displacement of the first element 122 in relation to the second element 124.

FIG. 2*c* shows the coin output unit 120 in an open state, characterized by the second element 124 being in an open position. When the coin output unit 120 is in an open state, the user may access the content of the first element 122. The opening of the coin output unit is realized using a displacement of the second element 124 in relation to the front face 102. The second element 124, when the first element 122 is in the second position 122B, is displaceable in relation to the front face 102 for carrying the first element 122 to an output position 122C, where the first element 122 at least partially protrudes from the front face 102.

Thus, by the operations disclosed hereinabove, the coin output unit 120 may, while being in a closed state, receive coins from a coin storage unit 120 being located at quite some distance from the front face 102, for example in the vicinity of the rear of the machine 100, yet still allow a user to easily and ergonomically access the coins when the coin output unit 120 is in an open state. For instance, the second element 124 need not be extended far away from the front face 102 in order for the first element 122 to protrude from the front face 102.

The first element 122 may be displaceable in relation to the second element 124 in many ways. For example, the first element 122 may be linearly displaceable in relation to the second element 124. The displacement may be facilitated by the use of a mechanical displacement system. For example, the first element 122 may be movably mounted to the second element 124 by means of a first rail system 160. The first rail system 160 may be of the type where the weight is carried by ball bearings.

It should be understood that, although indicated to be horizontal in FIGS. 1 and 2*a-c*, the displacement of the first element 122 in relation to the second element 124 does not have to be horizontal. Alternatively, the displacement may be along a direction forming an inclination angle with the horizontal axis. The inclination angle may be positive or negative.

It should also be understood that the displacement of the first element 122 in relation to the second element 124 may be other than linear. For example, it may be curvilinear, such as circular, elliptical or the like, or it may comprise more than one sub displacement following separate directions and/or paths. For example, the first element 122 may be displaceable in relation to the second element 124 not only along the depth dimension defined from the front face towards the rear of the machine, but also along the dimension defined from the left side to the right side of the machine 100, i.e. a dimension perpendicular to the depth dimension.

The second element 124 may be displaceable in relation to the front face 102 of the coin depositing and dispensing machine 100 in many ways. For example, the second element 124 may be linearly displaceable in relation to the front face 102. The displacement may be facilitated by the use of a mechanical displacement system. For example, the second element 124 may be movably mounted to the coin depositing and dispensing machine 100 by means of a second rail system 162. The second rail system 160 may be of the type where the weight is carried by ball bearings.

It should be understood that, although indicated to be horizontal in FIGS. 1 and 2*a-c*, the displacement of the second element 124 in relation to the front face 102 of the coin depositing and dispensing machine 100 does not have to be horizontal. Alternatively, the displacement may be along a direction forming an inclination angle with the horizontal axis. The inclination angle may be positive or negative.

It should also be understood that the displacement of the second element 124 in relation to the coin depositing and dispensing machine 100 may be other than linear. For example, it may be curvilinear, such as circular, elliptical or the like, or it may comprise more than one separate displacement following separate directions and/or paths. For example, the second element 124 may be displaceable in relation to the front face 102 not only along the depth dimension defined from the front face towards the back of the machine, but also along the dimension defined from the left side to the right side of the machine 100, i.e. a dimension perpendicular to the depth dimension.

The second element may comprise a front plate 170, which may be arranged to be flush with the front face 102 in a closed position of the second element 124 (i.e. when the output unit is in a closed state).

The coin depositing and dispensing machine 100 may further comprise a control unit 150. The control unit 150 may comprise a processing unit. The control unit 150 may receive input from sensors in the machine 100 and may execute processing instructions for determining how coins are to be handled in view of the sensed input. The control unit 150 may also be arranged to send control signals to different machine parts, so as to control function of the machine parts, such as activating or deactivating a motor for driving an element. The control unit 150 may also register transactions performed by the machine 100 and may communicate information on such transactions and/or information on a status of the machine to an external computer system.

The processing unit of the control unit 150 may be implemented as a microprocessor, which may be programmable for controlling operation of the microprocessor. For instance, the processing unit may be a central processing unit (CPU). The processing unit may alternatively be a special-purpose circuitry for providing only specific logical operations. Thus, the processing unit may be provided in the form of an application-specific integrated circuit (ASIC), an application-specific instruction-set processor (ASIP) or a field-programmable gate array.

The control unit 150 may further comprise a non-volatile memory for storing information, such as instructions for controlling operation of the processing unit and log data of transactions performed by the machine 100.

The control unit 150 may further comprise a communication unit for sending control signals, in order to control functionality of other components of the machine 100. The control unit 150 may be arranged to control displacing unit(s), ejection/counter of containers 110, etc.

The control unit 150 may be arranged to determine the position of the first element 122 with respect to the front face 102. The control unit 150 may thus receive input from a sensor unit arranged to measure the position of the first element 122. The sensor unit may be arranged to also measure the position of the second element 122. Alternatively, more than one sensor unit is used.

The coin depositing and dispensing machine 100 may comprise a second displacing unit, arranged to displace the second element 124 in relation to the front face 102. The second displacing unit may be arranged to displace the second element 124 at least between the second position 122B and the output position 122C. The second displacing unit may be controlled by the control unit 150. The second displacing unit allows for easy opening and closing of the coin output unit.

Alternatively, or additionally, the coin depositing and dispensing machine 100 may comprise a locking unit arranged to secure the second element 124 within the coin depositing and dispensing machine 100 such that the output unit 120 is in a locked state. When being in a locked state, the coin output unit 120 is in a closed state (i.e. the second element 124 being in a closed position). The locked state is further characterized by the user being prevented from displacing the second element 124, as the front plate 170 of the second element 124 is flush with the front face 102. The locking unit may be controlled by the control unit 150.

If large amounts of coins are deposited into the machine 100, container(s) 110 may start to fill up. If a container 110 is completely filled, jams of coins may occur upstream in transport of coins.

Thus, the machine 100 may comprise a sensor for detecting whether an overflow of coins in a container 110 is about to occur. For instance, the sensor may detect whether the amount of coins exceed a threshold level, e.g. by an optical sensor detecting whether a level of coins in the container is above the threshold level. Alternatively, the control unit 150 may keep track of the number of coins in the container 110 and determine whether the number of coins exceed a threshold. To prevent an over-flow of coins within the machine 100, coins may be output from a container 110 when the number of coins exceed the threshold. However, overflow coins should not be output from the container 110 into the coin output unit 120, since the overflow coins should not be output to a user.

For this purpose, the coin depositing and dispensing machine 100 may further comprise a transport box 180 arranged to receive coins from the coin storage unit 108. The coins may be received by the transport box 180 from the coin storage unit 108 when the first element 122 is in the second position 122B. Thus, the first element may be displaced from the first position 122A to the second position 122B in order for coins to be able to fall from the coin storage unit 108 to the transport box 180. The transport box 180 may be located under the coin storage unit 108. Preferably, the transport box 180 is located under the output of the at least one container 110.

The transport box 180 may be locked to the machine 100 or may be removed from the machine 100 through a locked door, such that only authorized personnel may access the transport box 180 and empty the transport box 180.

In one embodiment, the transport box 180 may be removed through the rear of the machine 100. Thus, CIT personnel may interact with the machine 100 through an interface at the rear of the machine 100. The machine 100 may even be mounted through a wall, such that the front face 102 may be arranged in a publically accessible area, whereas the rear of the machine 100 may be arranged in a secure area allowing CIT personnel to interact with the machine 100 in a secure environment.

The rear of the machine 100 may also provide a further input unit allowing CIT personnel to fill the machine 100 with coins should there be a shortage of coins in any container 110. The further input unit may be connected to the coin processing unit 106 allowing the input coins to be validated and sorted before being filled into the containers 110 of the coin storage unit 108.

Referring now to FIG. 3*a*, a method for controlling output of coins from a coin depositing and dispensing machine 100 will be described. The method comprises determining, by a control unit 150, that a first element 122 is in a first position 122A, step S202. When being in the first position 122A, the first element 122 is able to receive coins output from a coin storage unit 108. The first element 122 may be located directly under the output of the coin storage unit 108, thus making it possible for the coins to leave the coin storage unit 108 and reach the first element 122 solely by means of gravity. Then, coins are output, step S204, from the coin storage unit 108. The first element 122 is then displaced, step S206, from the first position 122A to a second position 122B. The control unit 150 checks, step S208, that the first element 122 is in the second position 122B. The control unit 150 may then release a lock of the second element 124 allowing the second element 124 to be moved. A second element 124, arranged to carry the first element 122, is then displaced, step S210, in relation to a front face 102 of the coin depositing and dispensing machine 100. The purpose of this displacement is to carry the first element 122 to an output position 122C. The output position 122C is located such as to allow the first element 122 to at least partially protrude from the front face 102 of the coin depositing and dispensing machine 100. This allows for a user to retrieve coins output from the coin depositing and dispensing machine 100.

A motor may drive the second element 124 to be moved a short distance out from the front face 102. The user may then pull the second element 124 further to the output position 122C in order to retrieve coins.

When a large number of coins have been deposited in the machine 100, there may be a risk of overflow, as discussed hereinabove. To overcome this problem, a method of controlling the machine 100 may also comprise additional steps, which may be performed in relation to deposition of coins, and as illustrated in FIG. 3*b*. Firstly, a fill level FL of coins in a container of the storage unit 108 is detected, step S220. The fill level FL is then compared, step S222, to a threshold value TV. In case the fill level FL is above the threshold value TV, the first element 122 is displaced, step S224, from the first position 122A to the second position 122B. Coins are then output, step S226, by the storage unit 108, from the container of the storage unit 108 to a transport box 180.

It should be understood that fill levels may be measured in all of the at least one container 110. Preferably, one fill level is measured for each one of the at least one container 110. As an example, if the coin storage unit 108 comprises six containers, six fill levels, FL1, . . . , FL6 are measured. Each one of the fill levels are then compared to a threshold value. The threshold value may be the same for all six containers, but may, alternatively, be different. For example, the threshold value may be individual for each container, i.e. TV1, . . . , TV6. In such a case, six comparisons are made. The coin depositing and dispensing machine 100 may be arranged to displace the first element 122 in relation to the second element 124 for allowing output of coins to the transport box 180 if at least one of the comparisons results in a fill level exceeding a threshold value.

The embodiments herein are not limited to the above described examples. Various alternatives, modifications and equivalents may be used. Therefore, this disclosure should not be limited to the specific form set forth herein. This disclosure is limited only by the appended claims and other embodiments than the mentioned above are equally possible within the scope of the claims.

The invention claimed is:

1. A coin depositing and dispensing machine, said machine comprising:

a front face;

a coin input unit for input of coins into the machine;

a coin processing unit, which is arranged to receive coins input through the coin input unit, the coin processing unit being capable of determining a denomination of coins and sorting coins according to denomination;

a storage unit comprising at least one container for storing coins of a specific denomination;

a coin output unit comprising a first element and a second element, the second element being configured to carry the first element, and to move between an open position in which a user can access content of the first element and a closed position in which the user cannot access the content of the first element; and a displacing unit configured to displace the first element in relation to the second element between a first position in which the first element is arranged in relation to the at least one container for receiving coins output from the at least one container, and a second position in a vicinity of the front face, wherein when the second element is in the closed position, the displacing unit displaces the first element in relation to the second element from the first position in a direction towards the front face to the second position in the vicinity of the front face, and wherein the second element, when the first element is in the second position, is displaceable in relation to the front face from the closed position to the open position for carrying the first element to an output position, where the first element at least partially protrudes from the front face.

2. The coin depositing and dispensing machine according to claim 1, further comprising a control unit, arranged to determine the position of the first element with respect to the front face.

3. The coin depositing and dispensing machine according to claim 1, wherein at least part of the first element is box-shaped defining a space for receiving coins.

4. The coin depositing and dispensing machine according to claim 1, wherein the first element is linearly displaceable in relation to the second element.

5. The coin depositing and dispensing machine according to claim 1, wherein the first element is movably mounted to the second element by means of a first rail system.

6. The coin depositing and dispensing machine according to claim 5, wherein the second element is movably mounted to the coin depositing and dispensing machine by means of a second rail system.

7. The coin depositing and dispensing machine according to claim 1, wherein the second element has a front plate, which is arranged to be flush with the front face in a closed position of the second element.

8. The coin depositing and dispensing machine according to claim 1, wherein the first element is arranged to receive a receptacle having compartments for receiving different denominations of coins.

9. The coin depositing and dispensing machine according to claim 1, further comprising a transport box arranged to receive coins from the coin storage unit when the first element is in the second position.

10. The coin depositing and dispensing machine according to claim 1, wherein the second element includes a front plate that is arranged to seal the front face of the machine when the second element is in the closed position to prevent users from accessing the coin storage unit.

11. A method for controlling output of coins from a coin depositing and dispensing machine, the method comprising:

determining, by a control unit, that a first element is in a first position in relation to an output of a storage unit for receiving one or more coins output therefrom, outputting coins from the storage unit, displacing the first element in relation to a second element, with a displacing unit that is configured to displace the first element, from the first position to a second position in a vicinity of a front face of the coin depositing and dispensing machine, when the second element is in a closed position in which a user cannot access content of the first element, controlling, by the control unit, that the first element is in the second position, and displacing the second element, in relation to the front face of the coin depositing and dispensing machine, from said closed position to an open position in which a user can access the content of the first element for carrying the first element to an output position, where the first element at least partially protrudes from the front face of the coin depositing and dispensing machine, whereby a user is allowed to retrieve coins output from the coin depositing and dispensing machine.

12. The method according to claim 11, further comprising:

detecting a fill level of coins in a container of the storage unit;

comparing the fill level to a threshold value; and in case the fill level is above the threshold value, displacing the first element from the first position to the second position, and outputting, by the storage unit, coins from the container of the storage unit to a transport box.

* * * * *